US008428498B2

(12) United States Patent
Fujiwara et al.

(10) Patent No.: US 8,428,498 B2
(45) Date of Patent: Apr. 23, 2013

(54) FIXING DEVICE AND IMAGE FORMING APPARATUS INCLUDING SAME

(75) Inventors: Hidehiko Fujiwara, Tokyo (JP); Kazunori Bannai, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 371 days.

(21) Appl. No.: 12/379,233

(22) Filed: Feb. 17, 2009

(65) Prior Publication Data

US 2009/0208264 A1 Aug. 20, 2009

(30) Foreign Application Priority Data

Feb. 19, 2008 (JP) ..... 2008-037308

(51) Int. Cl.
*G03G 15/20* (2006.01)

(52) U.S. Cl.
USPC ..... 399/328; 219/216; 399/329

(58) Field of Classification Search ..... 399/328, 399/329; 219/216
See application file for complete search history.

(56) References Cited

U.S. PATENT DOCUMENTS

| | | | | |
|---|---|---|---|---|
| 5,732,318 | A * | 3/1998 | Natsuhara et al. | 399/329 |
| 6,151,466 | A | 11/2000 | Fujiwara | |
| 6,542,712 | B2 | 4/2003 | Kamijo et al. | |
| 6,731,900 | B2 | 5/2004 | Takenaka et al. | |
| 6,731,902 | B2 | 5/2004 | Takenaka et al. | |
| 6,785,506 | B2 * | 8/2004 | Kato et al. | 399/333 |
| 6,788,916 | B2 | 9/2004 | Takenaka et al. | |
| 6,801,744 | B2 | 10/2004 | Fujiwara et al. | |
| 6,841,758 | B2 * | 1/2005 | Eskey | 219/216 |
| 6,907,218 | B2 | 6/2005 | Fujiwara et al. | |
| 7,013,108 | B2 | 3/2006 | Takenaka et al. | |
| 7,076,198 | B2 * | 7/2006 | Kim et al. | 399/330 |
| 7,177,579 | B2 * | 2/2007 | Uchida et al. | 399/328 |
| 7,283,780 | B2 * | 10/2007 | Uchida et al. | 399/329 |
| 7,294,810 | B1 * | 11/2007 | Haseba et al. | 219/216 |
| 7,424,260 | B2 | 9/2008 | Nishiyama et al. | |

(Continued)

FOREIGN PATENT DOCUMENTS

| | | |
|---|---|---|
| CN | 1779578 | 5/2006 |
| JP | 58-190659 | 12/1983 |

(Continued)

OTHER PUBLICATIONS

Abstract of JP 2003-215965 published Jul. 30, 2003.

(Continued)

*Primary Examiner* — David Gray
*Assistant Examiner* — Erika J Villaluna
(74) *Attorney, Agent, or Firm* — Harness, Dickey & Pierce, PLC

(57) ABSTRACT

A fixing device includes a fixing member, a pressure member, a contact member, and a heater. The fixing member is provided in a width direction of a recording medium and to heat and fuse a toner image on the recording medium. The pressure member is to press against the fixing member. The contact member is provided inside the fixing member and to contact the pressure member through the fixing member to form a nip portion between the pressure member and the fixing member. The heater includes a heating element and is to heat the contact member. The heating element of the heater is a mold member of a relatively thin plate extending in a width direction of the fixing member and includes a flat surface that faces the contact member. An image forming apparatus for forming an image includes the fixing device.

25 Claims, 14 Drawing Sheets

U.S. PATENT DOCUMENTS

| | | | | |
|---|---|---|---|---|
| 7,551,846 | B2 | 6/2009 | Konishi et al. | |
| 7,778,584 | B2 | 8/2010 | Nishiyama et al. | |
| 7,860,442 | B2 * | 12/2010 | Nishikawa et al. | 399/329 |
| 7,962,082 | B2 * | 6/2011 | Takahashi et al. | 399/328 |
| 2003/0026632 | A1 | 2/2003 | Takenaka et al. | |
| 2003/0063933 | A1 | 4/2003 | Fujiwara et al. | |
| 2003/0063934 | A1 | 4/2003 | Takenaka et al. | |
| 2003/0099493 | A1 | 5/2003 | Takenaka et al. | |
| 2003/0103786 | A1 | 6/2003 | Fujiwara et al. | |
| 2004/0240914 | A1 | 12/2004 | Takenaka et al. | |
| 2006/0153605 | A1 | 7/2006 | Nishiyama et al. | |
| 2008/0124152 | A1 | 5/2008 | Nishikawa et al. | |
| 2008/0292376 | A1 | 11/2008 | Nishiyama et al. | |
| 2009/0010688 | A1 | 1/2009 | Takahashi et al. | |
| 2009/0116884 | A1 | 5/2009 | Nonaka et al. | |

FOREIGN PATENT DOCUMENTS

| | | | |
|---|---|---|---|
| JP | 03144477 | A * | 6/1991 |
| JP | 06-258971 | | 9/1994 |
| JP | 8-27571 | | 3/1996 |
| JP | 2000-206815 | | 7/2000 |
| JP | 2001-142327 | | 5/2001 |
| JP | 2002-031975 | | 1/2002 |
| JP | 2002031974 | A * | 1/2002 |
| JP | 2002031975 | A * | 1/2002 |
| JP | 2002-108119 | | 4/2002 |
| JP | 2003-215965 | | 7/2003 |
| JP | 2004-264531 | | 9/2004 |
| JP | 2005-085682 | | 3/2005 |
| JP | 3835298 | | 8/2006 |
| JP | 2007-025101 | | 2/2007 |
| JP | 2007233010 | A * | 9/2007 |

OTHER PUBLICATIONS

Abstract of JP 01-263680 published Oct. 20, 1989.
Office Action dated May 25, 2012 issued in corresponding Japanese Application No. 2008-037308.

* cited by examiner

FIXING DEVICE AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application No. 2008-037308 filed on Feb. 19, 2008 in the Japan Patent Office, the entire contents of which are hereby incorporated herein by reference.

BACKGROUND OF THE INVENTION

1. Field of the Invention

Exemplary aspects of the present invention generally relate to a fixing device and an image forming apparatus, such as a copier, a facsimile machine, a printer, or a multi-functional system including any combination thereof, and more particularly, to an image forming apparatus including the fixing device.

2. Description of the Background Art

A related art fixing device for an image forming apparatus, for example, that according to JP-H08-27571-B, is equipped with a heater, a film member that slidably moves with the heater, and a pressure member that is movable and presses against the heater through the film member.

In this fixing device, a recording medium bearing an unfixed toner image is sandwiched between the film member and the pressure member, and transported.

The place where the film member and the pressure member meet and press against each other is a so-called nip portion. In the related art fixing device, for various reasons a width of the heater is typically less than a width of the nip portion.

A drawback to the foregoing configuration is that, because the heater heats the recording medium through the film member, an undesirable amount of force is applied to the nip portion when paper jams occur and/or the heater is damaged when a foreign substance accidentally enters the nip portion.

Furthermore, when the recording medium, the width of which is narrower than the width of the nip portion, passes through the nip portion, a temperature of end portions of the heater rises significantly because there is no media present thereat to absorb the heat thus generated, thereby damaging the heater. In a case in which a primary current flows through the heater disposed substantially behind the thin film member, if the heater is damaged, a problem associated with electrical safety arises.

Another example of a known fixing device, disclosed in JP-S58-190659-U, is a belt-type fixing device in which a heater is disposed immediately before a nip portion between a pair of rollers, around which an endless belt is wound.

In this fixing unit, the endless belt is heated, and fixing is performed in the nip portion between the pair of rollers.

With this configuration, although the endless belt can be heated relatively fast, the pair of rollers is not easily heated because a heat capacity of the rollers is relatively large. Consequently, it is barely possible to raise a fixing temperature from room temperature to an appropriate temperature for fixing quickly when fixing needs to be performed.

In order to achieve a desired temperature in a short period of time, electric power needs to be applied to the heater constantly so as to keep the rollers heated to the desired temperature even if no recording medium passes between the nip portion, thereby defeating the purpose of reducing power consumption and improving image fixability.

Another example of a known fixing device, disclosed in Japanese Patent No. 3835298, is equipped with a carbon-based heater in which a heating value or an amount of radiant heat is changed by providing holes at predetermined locations in a longitudinal direction of a heating element of the carbon-based heater, in this case, a carbon lamp, to change a resistance value of the heater.

In Japanese Patent No. 3835298, although a method of changing the heating value or the amount of radiant heat of the carbon lamp is disclosed, the actual use of the carbon lamp is not disclosed.

In general, in a heating device used in a known fixing unit, power is often supplied from an end portion of a heating element of the heating mechanism in the longitudinal direction thereof. For this reason, in order to secure a heating area, a length of the heater tends to be relatively long.

Furthermore, in a case in which the heating device is disposed inside the pressure member or the fixing member, heat escapes from the end portions of the heating element to the outside of the fixing member and the pressure member. The amount of heat slipping through the end portions of the heating element is greater than the amount of heat escaping from the center thereof. For this reason, the temperature at the end portions of the pressure member or the fixing member drops easily, causing fixing failure.

SUMMARY OF THE INVENTION

Illustrative embodiments of the present invention provide a fixing device that is compact and achieves a desired fixing temperature when needed, and an image forming apparatus including the fixing device.

According to one preferred embodiment, the fixing device includes a fixing member, a pressure member, a contact member, and a heater. The fixing member is provided in a width direction of a recording medium and configured to heat and fuse a toner image on the recording medium. The pressure member is configured to press against the fixing member. The contact member is provided inside the fixing member and configured to contact the pressure member through the fixing member to form a nip portion between the pressure member and the fixing member. The heater includes a heating element and is configured to heat the contact member. The heating element of the heater is a mold member of a relatively thin plate extending in a width direction of the fixing member and includes a flat surface that faces the contact member.

According to another preferred embodiment, an image forming apparatus for forming an image includes an image bearing member, a developing device, a transfer device, and the fixing device. The image bearing member is configured to bear an electrostatic latent image on a surface thereof. The developing device is configured to develop the electrostatic latent image formed on the image bearing member using toner to form a toner image. The transfer device is configured to transfer the toner image on the image bearing member onto a recording medium.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
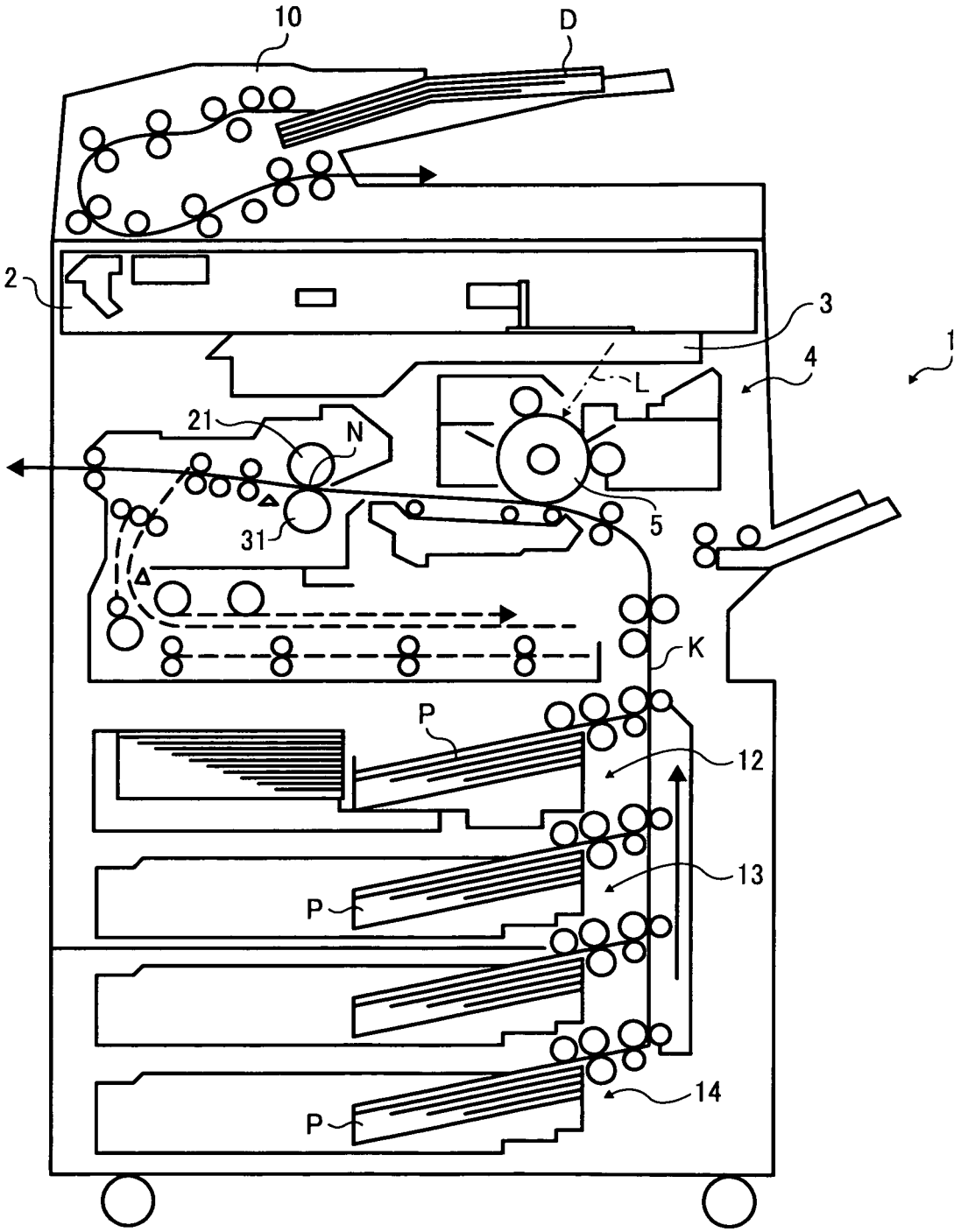
FIG. 1 is a schematic diagram illustrating an example of an image forming apparatus according to an illustrative embodiment of the present invention.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

Referring now to FIG. 1, there is provided a schematic diagram illustrating a copier as an example of an image forming apparatus that employs a fixing device 20 according to the illustrative embodiment.

In FIG. 1, the image forming apparatus 1 includes a document reader 2, an exposure unit 3, an image forming unit 4, a photoreceptor drum 5 serving as an image bearing member, a transfer unit 7, a sheet conveyer 10, sheet feeding devices 12 through 14, a fixing device 20, a fixing film 21, a pressure roller 31.

The document reader 2 optically reads image information of a document D. The exposure unit 3 illuminates the photoreceptor drum 5 with an exposure light L based on the image information read by the document reader 2.

The image forming unit 4 forms a toner image (visible image with toner) on the photoreceptor drum 5. The transfer unit 7 transfers the toner image formed on the photoreceptor drum 5 onto a recording medium P.

The sheet feeding devices 12 through 14 store the recoding medium P or a stack of recording media sheets such as transfer paper.

The sheet conveyer 10 transports the document D being set to the document reader 2.

The fixing device 20 fixes the unfixed toner image on the recording medium P. The fixing device 20 includes the fixing film 21 serving as a fixing member, the pressure roller 31 serving as a pressing member, and so forth. As will be described later, the fixing film 21 and the pressure roller 31 form a so-called nip portion therebetween.

With reference to FIG. 1, a description is provided of the image forming apparatus 1 during normal operation.

The document D is transported from a document table in a direction indicated by arrow by conveyance rollers of the sheet conveyer 10 and passes over the document reader 2. When the document D passes over the document reader 2, the document reader 2 optically reads image information of the document D.

The image information optically read by the document reader 2 is converted to electric signals and transmitted to the exposure unit 3, also known as a writing unit. Based on the electric signal of the image information, the exposure unit 3 illuminates the photoreceptor drum 5 of the image forming unit 4 with the exposure light L such as a laser beam or the like.

In the image forming unit 4, the photoreceptor drum 5 rotates in a clockwise direction in FIG. 1. The surface of the photoreceptor drum 5 is charged and exposed so that a latent image is formed thereon. Subsequently, the latent image on the photoreceptor drum 5 is developed with toner, thereby forming a toner image associated with the image information on the photoreceptor drum 5.

In the transfer unit 7, the image formed on the photoreceptor drum 5 is transferred onto the recording medium P transported by registration rollers, not illustrated.

A description is now provided of transport of the recording medium P to the transfer unit 7. One of the sheet feed devices 12 through 14 in the image forming apparatus 1 is automatically or manually selected. For example, the sheet feed device 12 at the top is selected.

A top sheet in the stack of recording media sheets stored in the sheet feed device 12 is transported to a sheet conveyance path K. The recording medium P being transported passes through the sheet conveyance path K and arrives at the registration rollers.

When the recording medium P arrives at the registration rollers, the recording medium P is transported to the transfer unit 7 in appropriate timing such that the recording medium P is aligned with the toner image formed on the photoreceptor drum 5.

After the image is transferred onto the recording medium P in the transfer unit 7, the recording medium P passes the transfer unit 7 and then arrives at the fixing device 20. The recording medium P arrived at the fixing device 20 is transported between the fixing film 21 and the pressure roller 31.

Due to heat from the fixing film 21 and pressure of both the fixing film 21 and the pressure roller 31, the unfixed toner image on the recording medium P is fused and fixed in the nip portion N between the fixing film 21 and the pressure roller 31.

After the image is fixed on the recording medium P, the recording medium P is released from the nip portion N between the fixing film 21 and the pressure roller 31 and discharged from the image forming apparatus 1. Accordingly, a sequence of image forming operation is completed.

Figure 2:
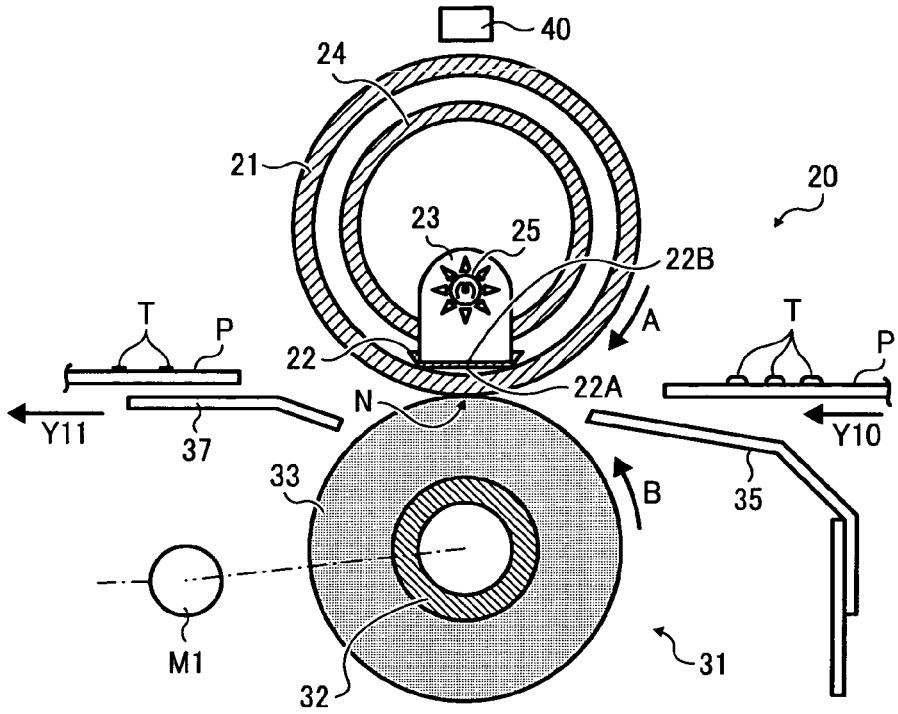
FIG. 2 is a schematic diagram illustrating a main portion of a fixing device employed in the image forming apparatus of FIG. 1 according to an illustrative embodiment of the present invention.
Figure 3:
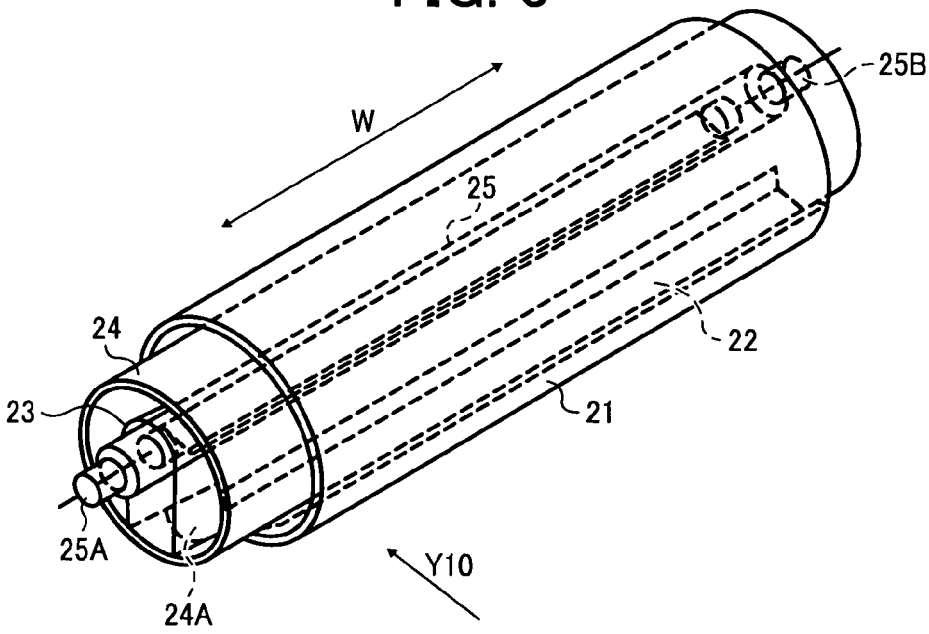
FIG. 3 is a perspective view of the fixing device of FIG. 2 according to an illustrative embodiment of the present invention.

With reference to FIGS. 2 and 3, a description of the fixing device 20 employed in the image forming apparatus 1 is provided. FIG. 2 is a schematic diagram illustrating a main portion of the fixing device 20 according to the illustrative embodiment. FIG. 3 is a perspective view of the main portion of the fixing device 20.

As illustrated in FIGS. 2 and 3, the fixing device 20 includes the fixing film 21, a contact member 22 serving as a heating member, a reflective plate 23, a retainer 24, an infrared heater 25, the pressure roller 31, and guide panels 35 and 37.

As illustrated in FIG. 3, the fixing film 21 is provided extending in a sheet width direction W of the recording medium P and serves as a fixing member. The contact member 22 serves as a heating member. The reflective plate 23 serves as a reflective member. The infrared heater 25 serves as a heating member. The pressure roller 31 serves as a pressing member.

The fixing film 21 is an endless film that is relatively thin and flexible. Material for the fixing film 21 may include, but is not limited to, polyimide, polyamide, fluororesin, metal, and so forth. The fixing film 21 rotates in a clockwise direction indicated by arrow A.

In order to facilitate releasability relative to toner T (toner image), the fixing film 21 may include a release layer. A surface layer of the fixing film 21 may include the release layer formed of, but not limited to, perfluoro alkyl vinyl ether copolymer resin (PFA), polyimide, polyetherimide, polyether sulfide (PES), and so forth.

When the fixing film 21 having a relatively low heat capacity is employed as a fixing member in the fixing device, it is possible to significantly reduce the rise time of the fixing device.

Inside the fixing film 21 that is equivalent to the inner loop of the fixing film 21, the infrared heater 25, the contact member 22, the reflective plate 23, the retainer 24, and so forth are disposed.

The fixing film 21 is pressed by the contact member 22, thereby forming the nip portion N between the fixing film 21 and the pressure roller 31.

The contact member 22 is formed of a metal plate or a plate member made from ceramic or polyimide resin having a thickness of approximately 0.1 mm. The contact member 22 is heated by radiant heat from the infrared heater 25. The contact member 22 contacts the pressure roller 31 through the fixing film 21, thereby forming the desirable nip portion N therebetween.

Figure 4:
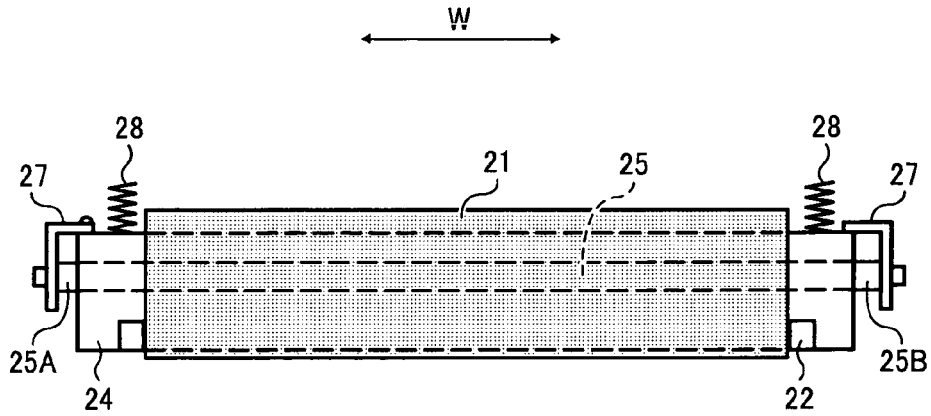
FIG. 4 is a schematic diagram illustrating a portion of the fixing device as viewed from a direction of sheet transport according to an illustrative embodiment of the present invention.

As illustrated in FIGS. 3 and 4, the contact member 22 is provided extending in a width direction W. The contact member 22 is supported by and fixed to the retainer 24 such that the contact member 22 faces an opening 24A formed in the retainer 24.

According to the illustrative embodiment, as illustrated in FIG. 2, an opposing surface 22A of the contact member 22, that is, a surface facing the pressure roller 31, is substantially flat. With this configuration, the nip portion N becomes substantially parallel to the surface of the recording medium P bearing an image, thereby allowing the fixing film 21 to closely contact the recording medium P and thus enhancing fixability.

In addition, when the recording medium P passes the nip portion N, curling and/or wrinkles can be reduced, if not prevented entirely.

Furthermore, curvature of the fixing film 21 at an exit of the nip portion N is relatively large so that the recording medium P sent out from the nip portion N can be easily separated from the fixing film 21.

The surface of the contact member 22 that slidably contacts the fixing film 21 can be coated with fluororesin. Accordingly, abrasion of the surface of the inner loop of the fixing film 21 that slidably contacts the contact member 22 fixed to the fixing device 20 can be reduced.

As illustrated in FIG. 3, the reflective plate 23 is provided opposite the contact member 22 via the infrared heater 25 (substantially above the infrared heater 25 in FIG. 2).

In particular, the reflective plate 23 is provided opposite the contact member 22 with the infrared heater 25 therebetween. The reflective plate 23 extends in the width direction W. The reflective plate 23 is provided apart from the infrared heater 25.

The reflective plate 23 is formed of mirror-finished aluminum and disposed such that the reflective plate 23 reflects infrared radiation emitted from the infrared heater 25 to the contact member 22.

Accordingly, the radiant heat or the infrared radiation emitted from a heating element 250 described later is prevented from escaping to the side opposite the contact member 22. In other words, the radiant heat (the infrared radiation) emitted from the heating element 250 to the reflective plate 23 is reflected by the reflective plate 23 and enters the contact member 22, thereby enhancing heating efficiency of the contact member 22.

Alternatively, an opposing surface 22B of the contact member 22, that is, a surface facing the infrared heater 25, may be provided with an infrared radiation absorber that absorbs infrared radiation. In particular, the opposing surface 22B of the contact member 22 may be coated in black. Accordingly, infrared absorption of the contact member 22 can be enhanced, thus enhancing heating efficiency of the contact member 22.

With reference to FIGS. 3, and 4, a description is provided of the retainer 24. FIG. 4 is a schematic diagram partially illustrating the fixing device 20 as viewed from the direction of sheet transport.

As illustrated in FIGS. 3 and 4, the retainer 24 is substantially long in the width direction W and formed of heat resistant resin material. The retainer 24 is inserted into and through the inner loop of the fixing film 21 in the width direction W, both ends of the retainer 24 projecting from the ends of the fixing film 21.

Both ends of the retainer 24 that project from both ends of the fixing film 21 in the width direction W are supported by holders 27, each of which is mounted to a side plate of the fixing device 20, not illustrated, and serves as a second retainer.

The retainer 24 integrally holds the contact member 22, the reflective plate 23, and the infrared heater 25. The infrared heater 25 is held such that end portions 25A and 25B of the infrared heater 25 are held by the retainer 24 through the holders 27. The end portions of the retainer 24 in the width direction W and the holders 27 are fastened together by screws.

Each of the holders 27 includes a hole through which the end portions 25A and 25B of the infrared heater 25 can be relatively loosely inserted. As briefly mentioned above, each of the holders 27 is mounted to the side plate of the fixing device 20, not illustrated.

Figure 5:
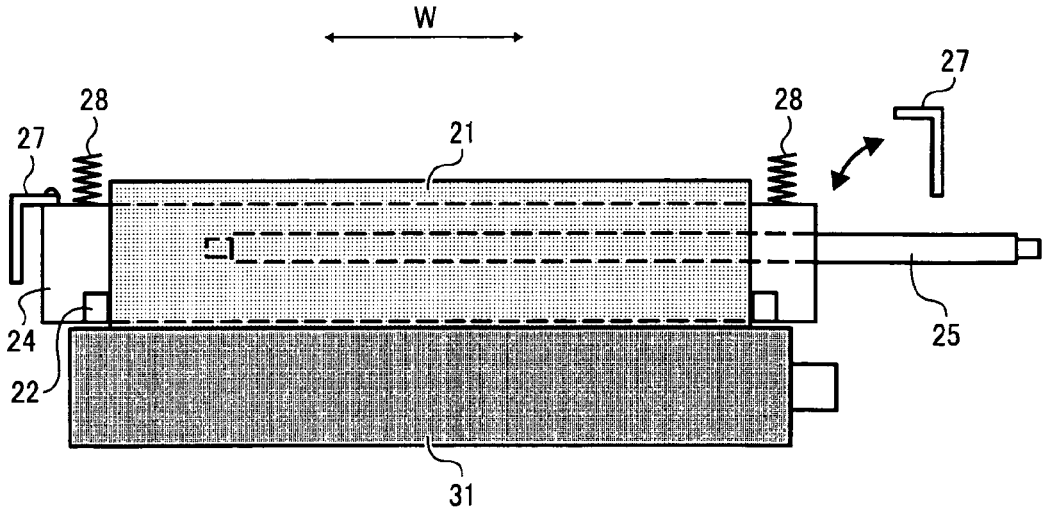
FIG. 5 is a schematic diagram illustrating installation of a heater according to an illustrative embodiment of the present invention.

Alternatively, as illustrated in FIG. 5, one of the holders 27 can be detachably mountable relative to the retainer 24 and the side plate of the fixing device 20. With this configuration, as illustrated in FIG. 5, merely the infrared heater 25 can be separated from the retainer 24 or the fixing device 20.

As illustrated in FIG. 4, a compression spring 28 is provided at each end of the retainer 24 in the width direction W. Accordingly, the contact member 22 is urged against the pressure roller 31, forming the nip portion N.

Referring back to FIG. 2, the retainer 24 is configured to guide the fixing film 21. In other words, an outer peripheral surface of the retainer 24 is formed circular so that the circular shape of the fixing film 21 which is relatively flexible can be maintained to some degree.

Furthermore, according to the illustrative embodiment, the retainer 24 has a cylindrical shape so that the contact member 22, the reflective plate 23, and the infrared heater 25 can be disposed inside the retainer 24, thereby preventing deterioration and/or damage due to deformation of the fixing film 21.

As illustrated in FIG. 2, the pressure roller 31 consists of a metal core 32 on which an elastic layer 33 is disposed. The elastic layer 33 is formed of material such as fluoro-rubber, silicone rubber, expandable silicone rubber, or the like.

Alternatively, a surface layer of the elastic layer 33 may include a thin parting layer (tube) formed of PFA or the like.

The pressure roller 31 presses against the fixing film 21 so as to form the nip portion N therebetween. The pressure roller 31 is rotatably mounted to the side plate of the fixing device 20, not illustrated, through a shaft bearing, and rotated in a counterclockwise direction indicated by arrow B in FIG. 2 by a drive mechanism, not illustrated. Frictional force between the fixing film 21 and the pressure roller 31 that rotates causes the fixing film 21 to move in the direction indicated by arrow A.

Substantially near the start of the nip portion N where the fixing film 21 contacts the pressure roller 31, the guide panel 35 is provided so as to guide the recording medium P to the nip portion N.

Substantially near the end of the nip portion N, the guide panel 37 is provided so as to guide the recording medium P sent out from the nip portion N. Both the guide panels 35 and 37 are fixed to a frame or a housing of the fixing device 20.

Referring now to FIG. 3, a description is provided of the infrared heater 25. The infrared heater 25 serving as a heating device is a carbon-based heater, for example. As illustrated in FIG. 3, the infrared heater 25 is provided inside the retainer 24 and fixed to the holders 27 of the fixing device 20 through the end portions 25A and 25B of the infrared heater 25.

When power is supplied to the heating element 250 from a power source, not illustrated, of the image forming apparatus 1, the infrared heater 25 generates heat, thereby heating the contact member 22.

Subsequently, the contact member 22 being heated heats the fixing film 21. Heat from the surface of the fixing film 21 heats the unfixed toner image T on the recording medium P.

The image forming apparatus 1 includes a control mechanism, not illustrated. The power source, not illustrated, and a temperature sensor 40 such as a thermistor are connected to the control mechanism.

The temperature sensor 40 is disposed facing the front surface of the fixing film 21. Accordingly, the temperature of the surface of the fixing film 21 can be detected. Based on the detected result of the temperature of the film surface, output or the temperature of the infrared heater 25 is controlled.

When the output of the infrared heater 25 is controlled in a manner described above, the temperature of the fixing film 21, that is, the fixing temperature, can be set to a desirable temperature.

Furthermore, the control mechanism is configured not to supply power to the infrared heater 25 when no recording medium P passes the fixing unit 20, thereby reducing standby power.

A description is now provided of operation of the fixing unit 20. When the image forming apparatus 1 is turned on, power is supplied to the infrared heater 25, and the pressure roller 31 starts to rotate in the direction indicated by arrow B in FIG. 2, causing the fixing film 21 to rotate in the direction of arrow A in FIG. 2 due to the frictional force.

Subsequently, the recording medium P is fed from one of the sheet feed devices 12 through 14 to the image forming unit 4. In the image forming unit 4, the toner image T is transferred onto the recording medium P.

Subsequently, the recording medium P bearing the unfixed toner image T is guided and transported in the direction indicated by arrow Y10 by the guide panel 35. The recording medium P is fed into the nip portion N between the fixing film 21 and the pressure roller 31 pressing each other.

Then, heat from the fixing film 21 having been heated by the contact member 22, and pressure of the contact member 22 (the fixing film 21) and the pressure roller 31 cause the unfixed toner image T on the surface of the recording medium P to be fixed thereon.

After the toner image T is fixed, the recording medium P exits the nip portion N in the direction indicated by arrow Y11.

Figure 6:
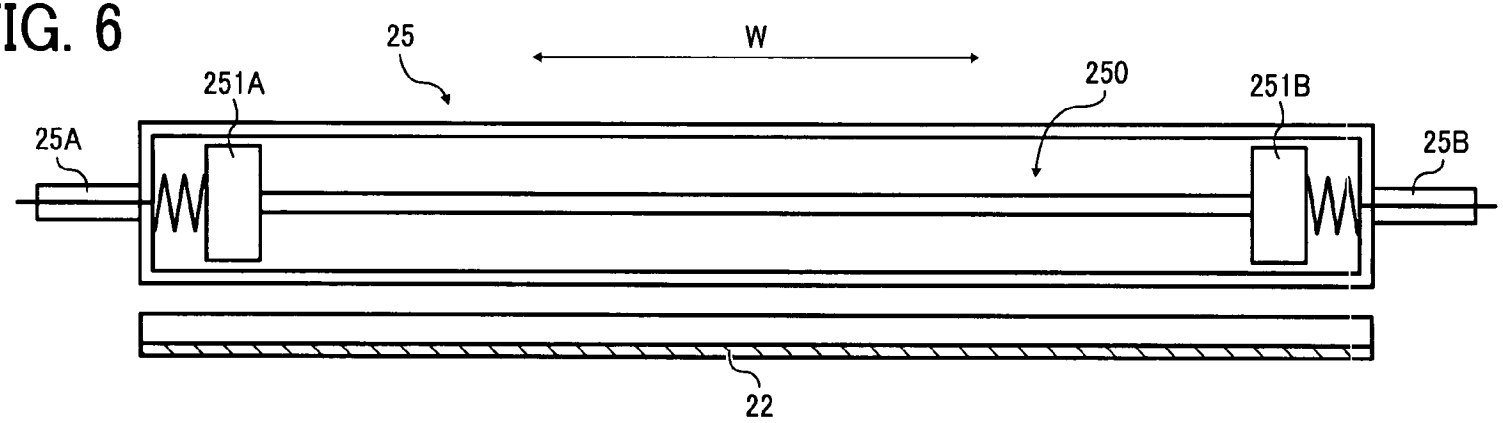
FIG. 6 is a schematic diagram illustrating an example of the heater according to an illustrative embodiment of the present invention.

With reference to FIG. 6, a description is provided of the infrared heater 25. FIG. 6 is a schematic diagram illustrating one example of the heating mechanism according to the illustrative embodiment.

Figure 11:
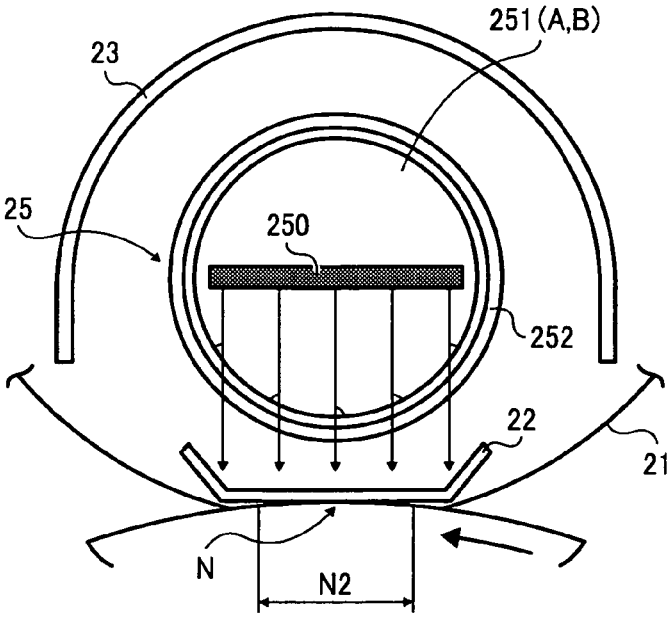
FIG. 11 is a schematic diagram illustrating a relation of a shape of a sealing tube, the heating element, and the contact member.

As illustrated in FIG. 6, the infrared heater 25 includes the heating element 250, a holder 251A, a holder 251B, and a sealing tube 252 (illustrated in FIG. 11).

The heating element 250 is formed of a mold member made of carbon material and extends in the width direction W. The holders 251A and 251B are configured to fix the end portions of the heating element 250 in the width direction W. The sealing tube 252 is made of transparent glass and seals the holders 251A and 251B inside thereof. The heating element 250 is disposed inside the retainer 24 so as to face the heating member 22.

According to the illustrative embodiment, power is supplied to the holder 251A, and the holder 251B is connected to ground.

The carbon-based heater is employed as the infrared heater 25, because inrush current relative to the heating element 250 is significantly low. When, compared with a halogen heater, the carbon-based heater provides greater flexibility in power control (ON/OFF control) thereof.

In particular, even if the power is repeatedly turned on and off before the duty cycle of the infrared heater 25 reaches 100%, disconnection does not occur, and thus reduction in the output over time can be prevented.

Furthermore, when compared with the halogen heater, the carbon-based heater generates heat relatively faster than the halogen heater when the power is applied. Accordingly, the rise time after the power is turned on is improved.

When using the carbon heater, it is preferable to form the carbon heater such that the amount of the radiant heat emitted in the direction facing the heat plate 22 that is the equivalent of a vertical direction in FIG. 2 is substantially greater than the amount of the radiant heat emitted in a direction perpendicular to the vertical direction, that is, in a horizontal direction in FIG. 2.

Accordingly, heat emitted from the heating element 250 can be concentrated to the contact member 22, thereby enhancing efficiency of heating the contact member 22.

Embodiment 1

Figure 7:
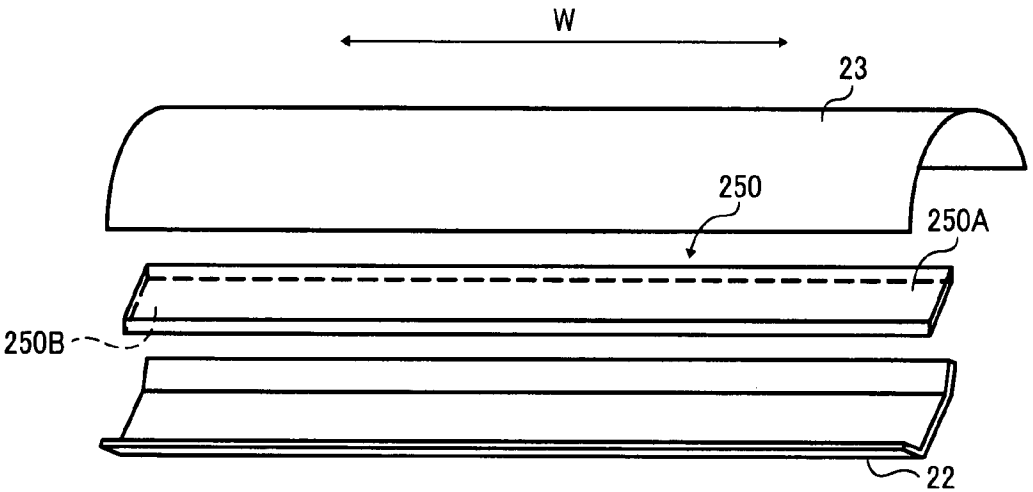
FIG. 7 is a schematic diagram conceptually illustrating a relative position of an example of a heating element, a contact member, and a reflection member according to an illustrative embodiment of the present invention.

According to the illustrative embodiment, as illustrated in FIG. 7, the heating element 250 is formed of the carbon-based mold member consisting of a substantially long and thin sheet extending in the width direction W.

In FIG. 7, the heating element 250 includes a first flat planar surface 250A and a second flat planar surface 250B. The first planar surface 250A is disposed facing the reflective plate 23. The second planar surface 250B is disposed opposite the first planar surface 250A and faces the contact member 22.

When the heating element 250 is formed in the thin plate, the amount of the radiant heat at the first planar surface 250A side can be increased, thereby enabling the heat emitted from the infrared heater 25 to be directed intensively to the contact member 22.

As a result, the contact member 22 can be efficiently heated so that the rise time can be reduced using less power while stabilizing fixing performance and thus obtaining a quality image. In particular, time for printing out a first sheet can be reduced.

Embodiment 2

Figure 8A:
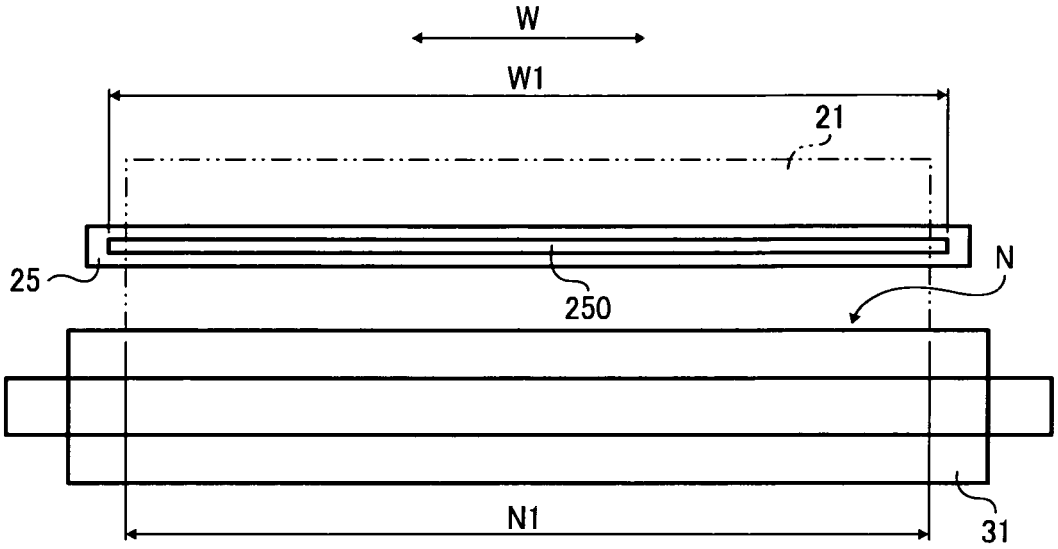
FIGS. 8A and 8B are schematic diagrams conceptually illustrating a relative position of the heating element and a nip portion as viewed from the direction of sheet transport and a sheet width direction according to a second embodiment of the present invention.
Figure 8B:
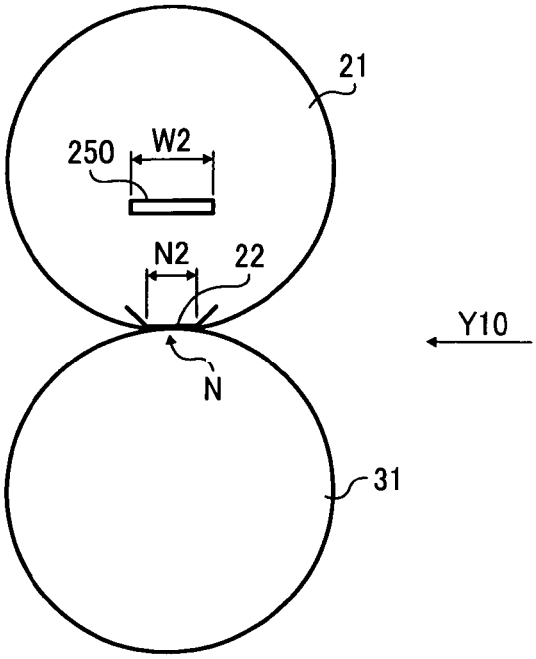

Referring now to FIGS. 8A and 8B, there are provided schematic diagrams illustrating the heating element 250 according to another embodiment.

The heating element 250 according to another embodiment is a thin plate member having a width W1 in the sheet width direction W greater than a nip length N1 of the nip portion N in the sheet width direction W.

Alternatively, as illustrated in FIG. 8B, a width W2 of the heating element 250 in the direction of sheet transport indicated by arrow Y10 substantially perpendicular to the sheet width direction W on the same plane of the width direction W is greater than a nip width N2 of the nip portion N.

With this configuration, when the width W1 of the heating element 250 is substantially greater than the nip length N1 or the width W2 of the heating element 250 is substantially greater than the nip width N2 of the nip portion N, the nip portion N can be evenly heated, thereby enhancing fixability.

Embodiment 3

With reference FIGS. 9A through 9D, variations of the heating element 250 are described. In a case in which each of a plurality of sheets of the recording media P has the same sheet width and is transported in the fixing device 20, end portions 250C and 250D of the heating element 250 in the sheet width direction W, that is, the longitudinal direction of the heating element 250, may appear outside the retainer 24 as can be seen in FIG. 4.

In such a case, even if the heating element 250 is heated, some heat escapes from substantially the end portions 250C and 250D to outside the fixing film 21 and/or the retainer 24. Consequently, the end portions of the contact member 22 near the end portions 250C and 250D of the heating element 250 and/or the end portions of the fixing film 21 are not adequately heated, possibly causing fixing failure.

In view of the above, the amount of the radiant heat radiated from at least one end portion of the heating element 250 is configured to be substantially larger than the other.

Figure 9A:
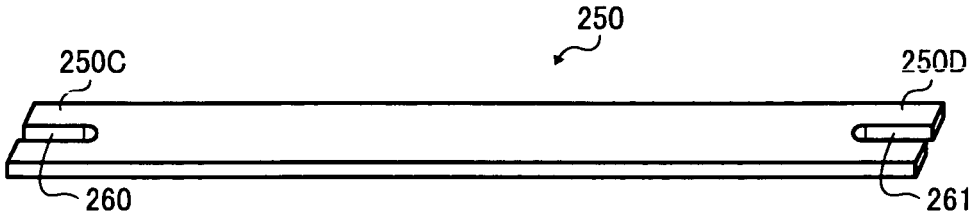
FIG. 9A through 9D are schematic diagrams illustrating the heating element according to a third embodiment of the present invention.

FIG. 9A illustrates the heating element 250 that includes notches 260 and 261 at the end portions 250C and 250D, respectively. The notches 260 and 261 can be easily formed when the heating element 250 is molded, necessitating no special manufacturing facility.

With this configuration, the infrared heater 25 in which the temperature of the end portions can be prevented from decreasing is attained with a simple configuration and at relatively low cost.

Figure 9B:
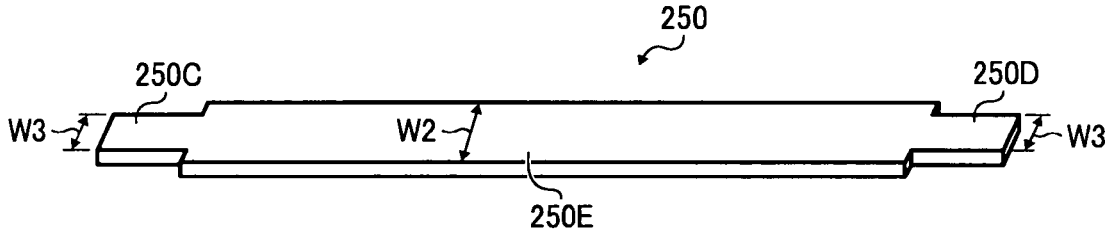

FIG. 9B illustrates another variation of the foregoing heating element 250. According to the present embodiment, a width W3 of the end portions 250C and 250D of the heating element 250 is substantially narrower than the width W2 of a center portion 250E of the heating element 250.

With this configuration, in the infrared heater 25, an amount of temperature drop at the end portions of the heating element 250 can be reduced without reducing heat generation in a center portion of the nip N.

Figure 9C:
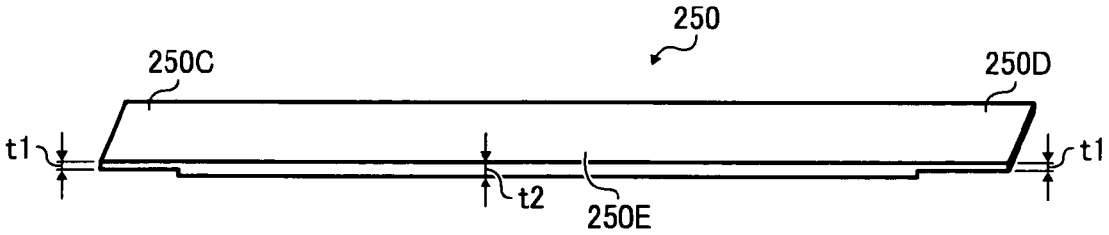

FIG. 9C illustrates another variation of the foregoing heating element 250. According to the present embodiment, a thickness t1 of the end portions 250C and 250D of the heating element 250 is substantially less than a thickness t2 of the center portion 250E. The thickness herein refers to a thickness in a direction facing the contact member 22 and the reflective plate 23.

With this configuration, an amount of temperature drop at the end portions 250C and 250D of the heating element 250 can be reduced without changing the heat generating width.

Figure 9D:
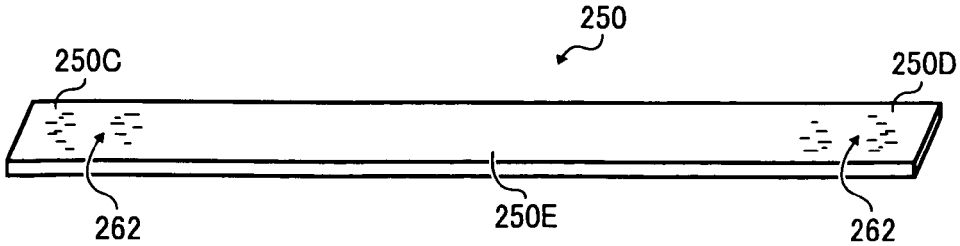

FIG. 9D illustrates another variation of the foregoing heating element 250. According to the present embodiment, an additive 262 is added to the heating element 250 so that electrical resistance at the end portions 250C and 250D becomes substantially greater than at the center portion 250E.

The electrical resistance of the heating element 250 can be partially changed by changing content of the additive 262. The material for the additive 262 includes, but is not limited to, ceramic powder such as metal carbide, metal boride, metal silicide, metal nitride, metal oxide, semimetal nitride, semimetal oxide and semimetal carbide.

With this configuration, an amount of temperature drop at the end portions 250C and 250D of the heating element 250 can be reduced without changing the heat generating width.

As described above, the electrical resistance at the end portions 250C and 250D of the heating element 250 is increased, thereby increasing the amount of the radiant heat, and thus preventing the temperature of the substantially end portions of the contact member 22 and the fixing film 21 from dropping as well as preventing fixing failure.

Furthermore, the amount of the radiant heat from the end portions 250C and 250D of the heating element 250 can be increased without significantly increasing the length of the heating element 250 as a whole for the sake of heat dissipation capacity, as is often seen in related-art techniques. Accordingly, the size of the fixing device and the cost thereof can be reduced.

The illustrative embodiments illustrated in FIGS. 9A through 9D can be selected in accordance with characteristics of the image forming apparatus or the fixing device.

According to the embodiment 3, the end portions of both 250C and 250D of the heating element 250 employ the above-described configurations capable of increasing the radiant heat. Alternatively, however, only one of the end portions 250C and 250D may employ the above-described configurations.

Figure 10:
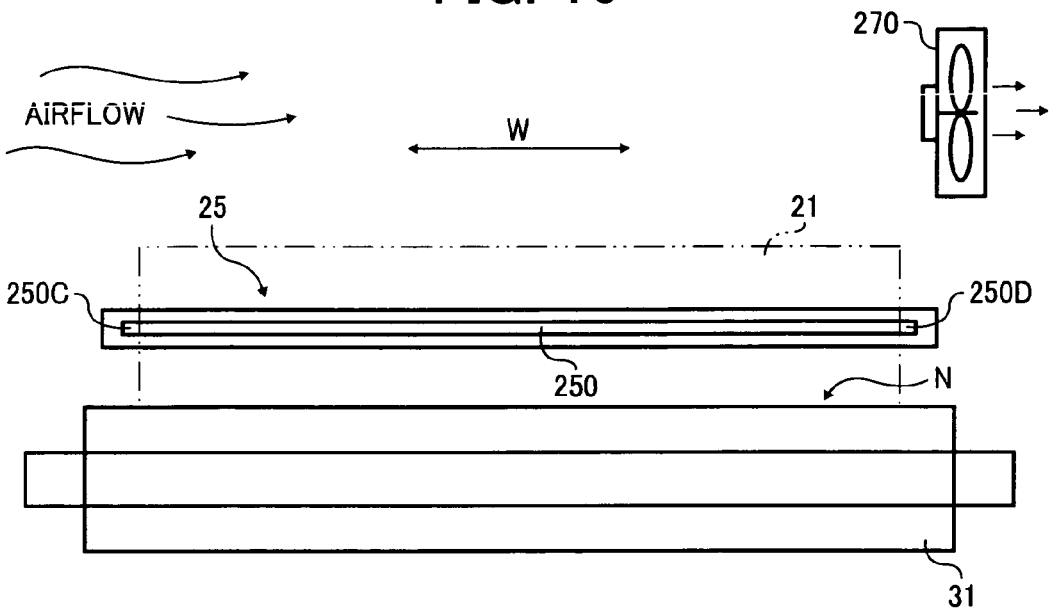
FIG. 10 is a schematic diagram for explaining a relation of airflow in the fixing device and radiant heat from the heating element.

As illustrated in FIG. 10, the image forming apparatus 1 is often equipped with an exhaust fan 270 so as to generate airflow inside the image forming apparatus 1 to exhaust heat.

When generating such airflow, the infrared heater 25 may be disposed such that the end portion 250C is located substantially upstream of the airflow, and the end portion 250D is located substantially downstream of the airflow, depending on the location of the fixing device 20.

In such a case, when the end portion 250C located substantially upstream of the airflow employs one of the configurations illustrated in FIGS. 9A through 9D, the temperature of the end portion 250C, which tends to easily decrease, can be increased, thereby preventing temperature decline.

According to the embodiment 3, the configurations capable of increasing the radiant heat from the end portions 250C and 250D of the heating element 250 are described, assuming that the plurality of sheets of the recording media P having the same sheet width is transported in the fixing device 20.

By contrast, in a case in which a large number of the recording media P having a width narrower than the nip length N1 of the nip portion N in the sheet width direction W passes the fixing device 20, the amount of heat absorbed by the recording media P may be insignificant, thereby causing the temperature of the end portions 250C and 250D to increase significantly.

In such a case, it is preferable that the length, width, or thickness of the notches 260 and 261 of the end portions 250C and 250D, or the amount of the additive 262 be adjusted so as to reduce the amount of the radiant heat.

Embodiment 4

As illustrated in FIG. 11, the sealing tube 252 is a substantially cylindrical glass member in cross-section, through which the heating element 250 and the holders 251A and 251B can be inserted.

With this configuration, the radiant heat of the heating element 250 penetrates through the sealing tube 252, thereby heating the contact member 22. However, since the sealing tube 252 has a curved surface, curvature of the surface of portions upstream and downstream of the nip portion N is more acute.

As a result, in contrast to substantially the center of the nip portion N, the areas substantially upstream and downstream of the nip portion N are easily affected by the shape of the sealing tube 252, possibly causing uneven distribution of heat in the nip.

Figure 12:
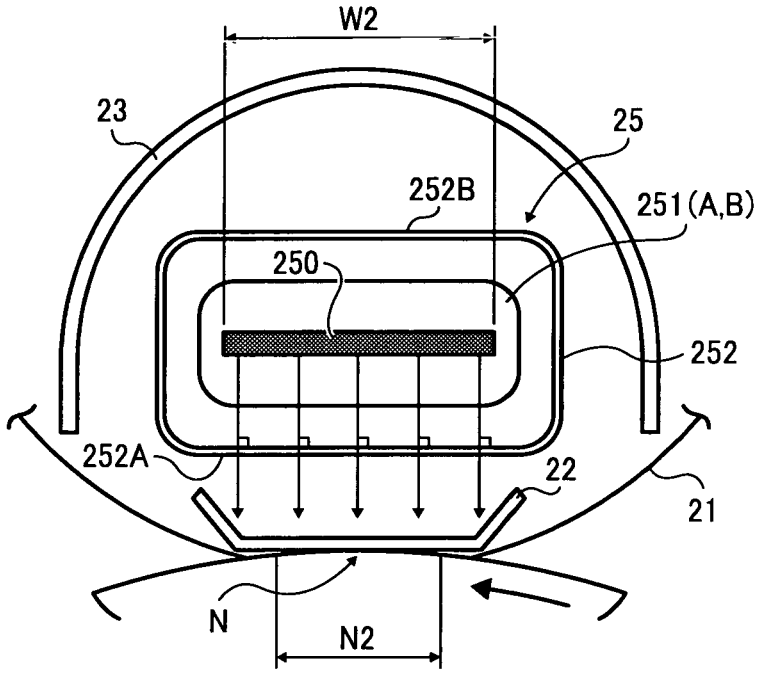
FIG. 12 is a schematic diagram illustrating the sealing tube, the heating element, and the contact member according to a fourth embodiment of the present invention.

In view of the above, a variation of the foregoing embodiment is illustrated in FIG. 12. As illustrated in FIG. 12, at least a portion of the sealing tube 252, in particular, a surface 252A facing the contact member 22 is configured to be substantially flat. The flat area of the surface 252A is the same as or greater than the width W2 of the heating element 250.

When the surface 252A between the heating element 250 and the contact member 22, facing the contact member 22, is substantially flat, the surface 252A is substantially perpendicular to infrared rays emitted from the heating element 250 to the contact member 22 in the entire nip width.

With this configuration, variation in infrared emissions relative to the nip width N2 is reduced, if not prevented entirely, and the heat can be evenly distributed in the nip, thereby enhancing fixability.

Furthermore, when the surface 252A is substantially flat, the contact member 22 can be disposed closer to the heating element 250 as compared with the sealing tube 252 having the curved surface.

Accordingly, the infrared rays can be efficiently transmitted from the heating element 250 to the contact member 22, thereby improving rise time and thus reducing printing time for the first print-out.

Since fixability is improved with this configuration, better imaging quality can be achieved. Still further, the reflective plate 23 can be disposed in the vicinity of the heating element 250, thereby reducing the size of the fixing device 20 as a whole.

Since the heating element 250 is a plate member, the radiant heat emitted from the heating element 250 penetrates through the sealing tube 252 made of transparent glass and disposed opposite the reflective plate 23, reaching the reflective plate 23.

In order to increase the amount of the radiant heat reaching the reflective plate 23, it is preferable that a portion of the sealing tube 252 relative to the reflective plate 23, that is, a surface 252B, be flat as well.

When the surface 252B is flat, the reflective plate 23 can be disposed in the vicinity of the heating element 250. Accordingly, the radiant heat (infrared rays) reflected by the reflective plate 23 is prevented from being diffused, thereby facilitating heating of the contact member 22 and distributing evenly the heat across the nip portion N in the entire nip width.

With this configuration, start-up upon receipt of print instruction is improved, thereby reducing the time needed for initial printing operation and achieving better imaging quality through better fixability.

In addition, since the reflective plate 23 is disposed in the vicinity of the heating element 250, the size of the fixing device 20 as a whole can be reduced.

Figure 13:
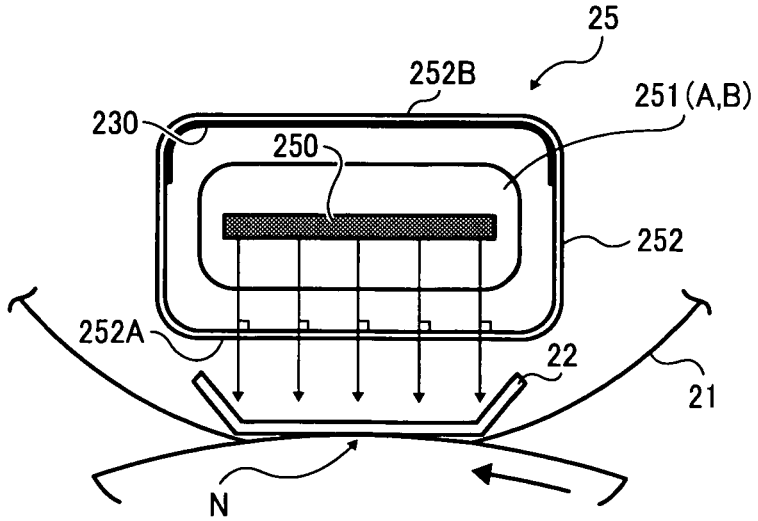
FIG. 13 is a schematic diagram illustrating a variation of the sealing tube.

According to the present embodiment, the reflective plate 23 is disposed apart from the infrared heater 25. Alternatively, as illustrated in FIG. 13, a reflective coating 230 is provided such that gold plating or aluminum deposition is applied to the surface 252B of the sealing tube 252 of the infrared heater 25.

In such a case, the reflective coating 230 of the gold plating or the aluminum deposition on the surface 252B serves as a reflective member, thereby reducing the distance to the contact member 22 and enhancing heating efficiency.

As a result, start-up upon receipt of print instruction is improved, thereby reducing the time needed for initial printing operation.

Furthermore, a certain amount of heat can be reliably maintained during continuous printing operation, thereby reliably maintaining fixability.

Embodiment 5

As illustrated in FIG. 13, when the reflective coating 230 of gold plating or aluminium deposition is provided on the surface 252B of the sealing tube 252, oxidation or evaporation of the reflective coating 230 may occur, reducing the reflection efficiency of the reflective coating 230.

Figure 14:
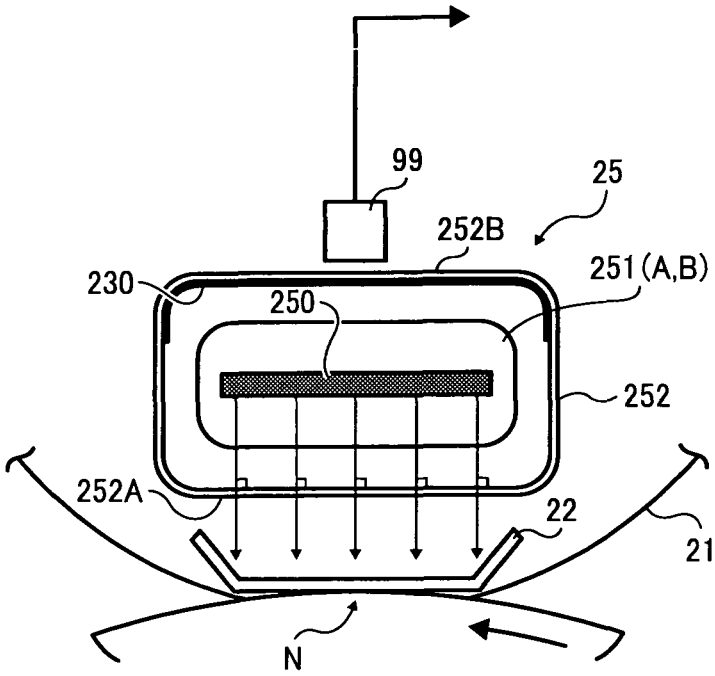
FIG. 14 is a schematic diagram illustrating the fixing device including a temperature sensor according to a fifth embodiment of the present invention.
Figure 15:
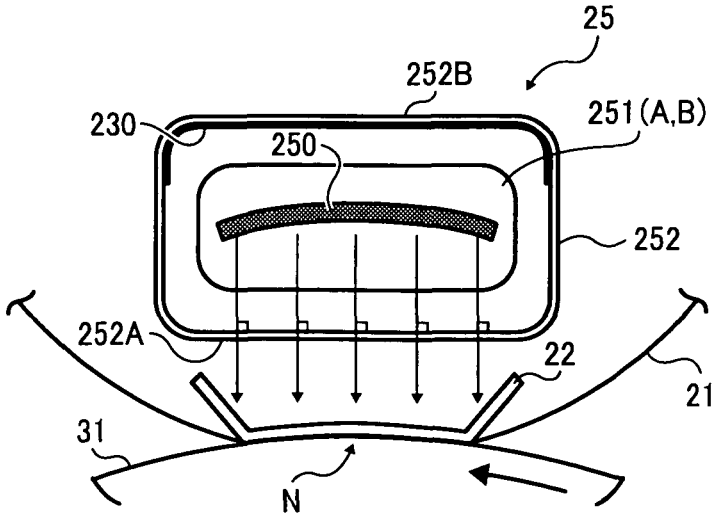
FIG. 15 is a schematic diagram illustrating a variation of the heating element.

In view of the foregoing, a variation of the foregoing embodiments is illustrated in FIG. 14. According to the embodiment 5, as illustrated in FIG. 14, a temperature sensor 99 that detects a temperature of the sealing tube 250 is disposed in the vicinity of the sealing tube 250.

When the temperature information output from the temperature sensor 99 indicates a predetermined temperature preset in a controller, not illustrated, power supply to the infrared heater 25 (heating element 250) is stopped.

When the temperature of the sealing tube 250 reaches a predetermined temperature, power is not supplied as described above in order to prevent deterioration of the reflective coating 230, therefore reliably maintaining stable reflectivity and thus stable fixability for an extended period of time.

According to the above-described illustrative embodiment, the contact member 22 serving as a heating member is a flexible metal (or ceramic or polyimide) plate member having a thickness of approximately 0.1 mm. Consequently, depending on the pressure exerted by the pressure roller 31, there is a possibility that the contact member 22 may deform along the peripheral surface of the pressure roller 31.

In view of the above, the shape of the heating element 250 is not limited to a flat shape as described above. Alternatively, the heating element 250 may conform substantially to the shape of the contact member 22 when the contact member contacts the pressure roller 31 via the fixing film 21.

According to the above-described illustrative embodiment, the contact member 22 can be deformed in an arch shape, the center portion of which is curved substantially higher than both ends of the arch. Therefore, the heating element 250 is formed in the similar shape as that of the contact member 22. Accordingly, the heating element 250 can be substantially parallel to the contact member 22, and thus able to efficiently heat the contact member 22.

According to the above-described illustrative embodiment, the pressure roller 31 serving as a pressure member is employed in the fixing device 20. Alternatively, a pressure belt or a pressure pad can be employed as a pressure member in the fixing device 20. In such a case, the same effect as that of the other foregoing embodiments can be achieved.

It is to be noted that elements and/or features of different exemplary embodiments may be combined with each other and/or substituted for each other within the scope of this disclosure and appended claims.

Moreover, the number of constituent elements, locations, shapes and so forth of the constituent elements are not limited to any of the structure for performing the methodology illustrated in the drawings.

For example, according to the illustrative embodiments described above, the contact member 22 facing the infrared heater 25 and disposed between the infrared heater 25 serving as a carbon-based heating element and the pressure roller 31, is formed such that the surface 22A (the surface facing the pressure roller 31) of the contact member 22 is substantially flat.

Figure 16:
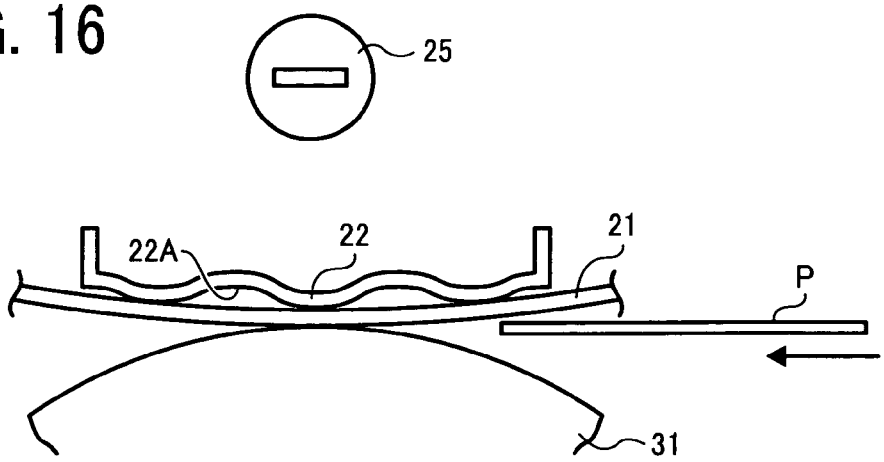
FIG. 16 is a schematic diagram illustrating a variation of the contact member having an irregular shape.

Alternatively, in order to facilitate separation of the recording medium P from the fixing film 21 serving as a fixing member, the surface 22A of the contact member 22 is not limited to a flat surface, but may be an irregular surface as illustrated in FIG. 16.

When the surface 22A has an irregular surface, the fixing film 21 and the pressure roller 31 do not tightly contact each other, thereby reducing adhesion between the recording medium P and the fixing film 21 in the nip portion N. Thus, the recording medium P can be separated from the fixing nip 21 with ease.

Figure 17:
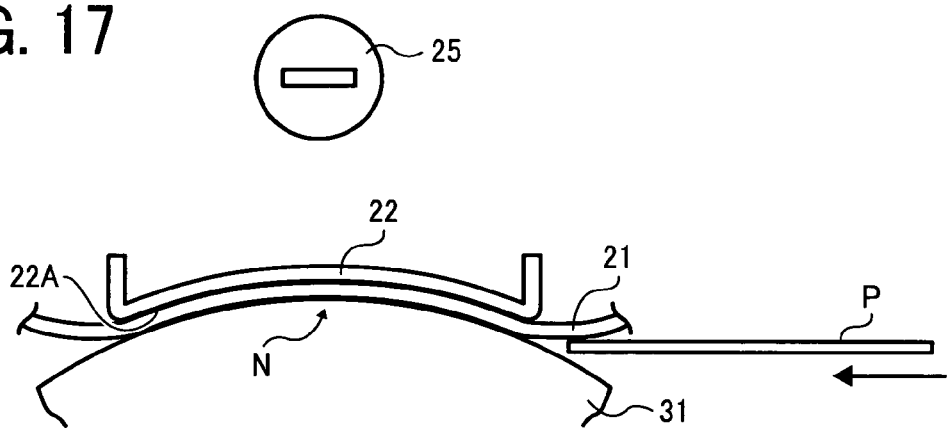
FIG. 17 is a schematic diagram illustrating the nip portion curved substantially toward a heater.

Alternatively, as illustrated in FIG. 17, the shape of the surface 22A of the contact member 22 can be formed such that the portion of the contact member 22 that forms the nip portion N together with the pressure roller 31 is curved or depressed substantially toward the infrared heater 25. In other words, the contact member 22 is curved or depressed toward the infrared heater 25 in the direction of sheet transport.

When the surface 22A or the nip portion N is curved toward the infrared heater 25, the end of the nip portion N is located substantially at the pressure roller 31 side. As a result, the recording medium P being transported in the nip portion N is forced to advance toward the pressure roller 31, facilitating separation of the recording medium P from the fixing film 21.

When the nip portion N has the curved shape or the depressed shape toward the infrared heater 25, separation force that enables the recording medium P to separate from the fixing film 21 is exerted on the recording medium P due to resilience of the recording medium P, thereby facilitating separation of the recording medium P from the fixing film 21.

When the surface 22A of the contact member 22 has the curved or the depressed shape, the nip pressure of the nip portion N can be distributed evenly, thus preventing a problem such as cockling or the like on the recording medium P.

In a case in which the contact member 22 or the nip portion N is formed in the curved or the depressed shape, when the curvature of the contact member 22 is substantially greater than that of the pressure roller 31, there is a gap between the contact member 22 and the pressure roller 31 so that the recording medium P is not adequately heated, resulting in a fixing problem or the like.

Figure 18:
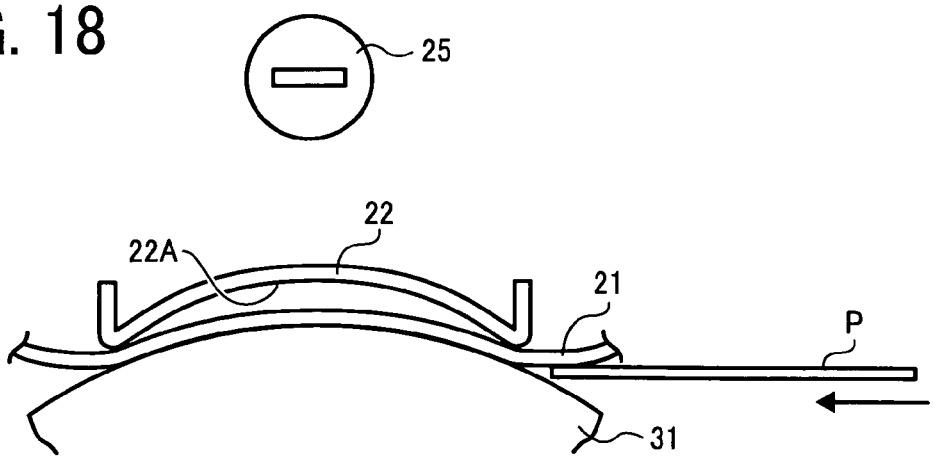
FIG. 18 a schematic diagram illustrating a variation of the contact member curved toward a heater.

In view of the above, as illustrated in FIG. 18, it is preferable that the curvature of the surface 22A of the contact member 22 be substantially smaller than the curvature of the pressure roller 31.

With this configuration, a uniform nip can be formed. Accordingly, adequate heat for fixing can be supplied to the recording medium P, thereby preventing the fixing failure and cockling on the recording medium P.

Figure 19A:
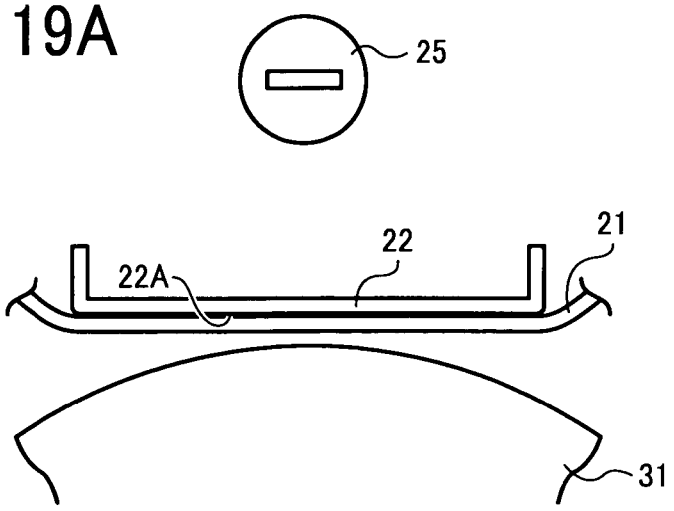
FIG. 19A is a schematic diagram illustrating a variation of the contact member before deformation.

As described above, the contact member 22 can be formed in the curved shape beforehand. Alternatively, as illustrated in FIG. 19A, when the pressure roller 31 does not press against the contact member 22, the contact member 22 is configured to be substantially flat.

Figure 19B:
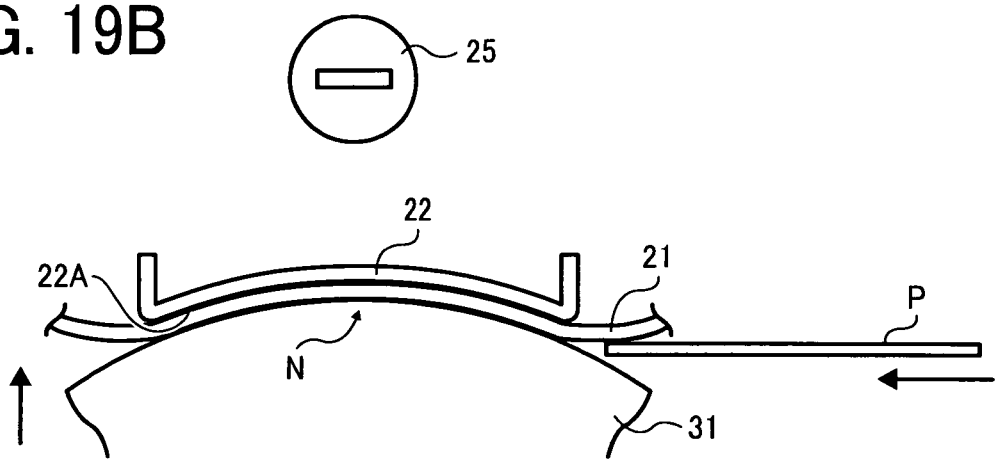
FIG. 19B is a schematic diagram illustrating the variation of the contact member after deformation.

By contrast, as illustrated in FIG. 19B, when the pressure roller 31 presses against the contact member 22 forming the nip portion N, the shape of the contact member 22 is configured to change into the curved or depressed shape by pressure of the pressure roller 31.

With this configuration, the contact member 22 can be simply formed flat and thus manufactured easily without complication. Accordingly, the contact member 22 can be made accurately at relatively low cost.

Figure 20:
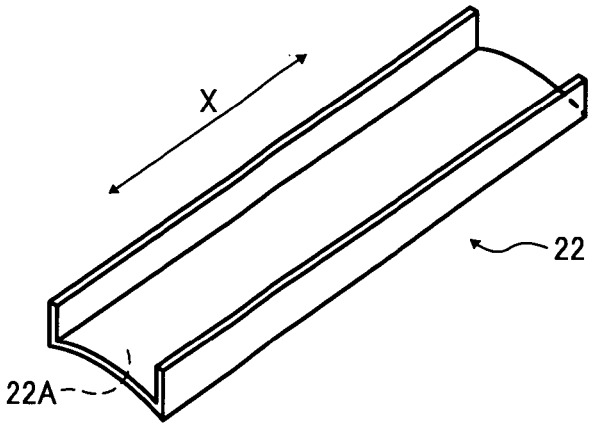
FIG. 20 is a schematic diagram illustrating the contact member curved in the direction of sheet transport.

Referring now to FIG. 20, there is provided a schematic diagram illustrating the contact member 22 when the contact member 22 is formed in the curved shape.

As illustrated in FIG. 20, the contact member 22 has substantially the same shape in cross section in a longitudinal direction X of the contact member 22 perpendicular to the sheet transport direction of the recording medium P on the same plane.

In this case, the length of the contact member 22 in the longitudinal direction X is configured greater than the maximum width of the recording medium P to be used in the image forming apparatus 1. Accordingly, any size of the recording medium P can be easily separated.

Figure 21:
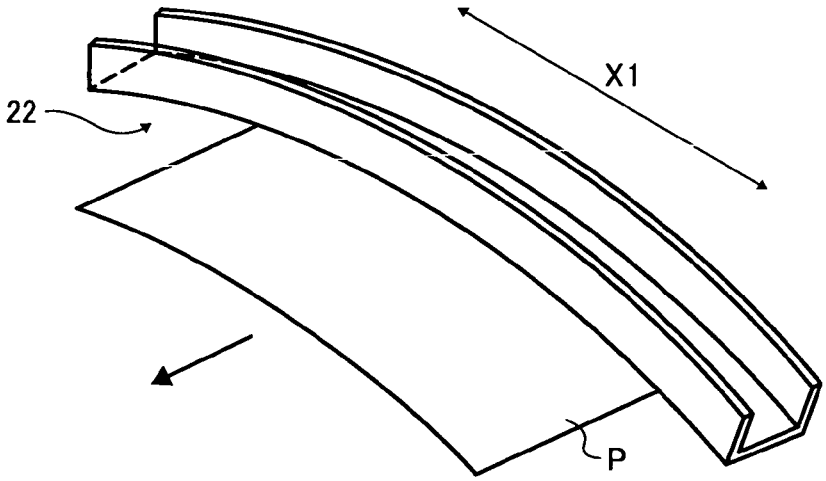
FIG. 21 is a schematic diagram illustrating the contact member curved in a longitudinal direction.

Alternatively, as illustrated in FIG. 21, the contact member 22 can be curved along the longitudinal direction X1. With this configuration, when the recording medium P is fed, the recording medium P is transported along the curve of the contact member 22, thereby increasing resilience of the recording medium P, as compared with the flat surface 22A.

As a result, after passing the nip portion N, resilience of the recording medium P causes the recording medium P to move in the nip direction, thereby facilitating separation of the recording medium P from the fixing film 21.

According to the illustrative embodiments, as illustrated in FIGS. 3 and 4, the contact member 22 is fixed to the cylindrical retainer 24 and faces the opening 24A.

Figure 22:
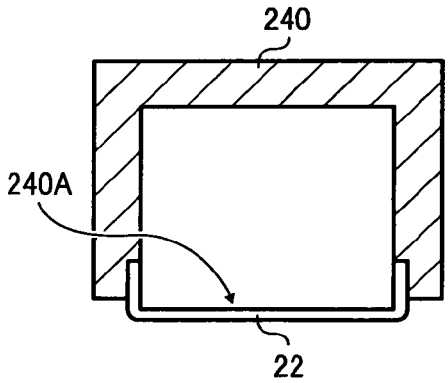
FIG. 22 is a schematic diagram illustrating another example of a retainer that holds the contact member according to an illustrative embodiment of the present invention.

Alternatively, as illustrated in FIG. 22, the contact member 22 can be fixed to a retainer 240 having an inverted U-shape. The retainer 240 includes an opening 240A substantially at the bottom thereof. The contact member 22 is fixed to the retainer 240 and faces the opening 240A.

Alternatively, the retainer 240 may be a bracket member that is held by the retainer 24. The retainer or the bracket member 240 is formed of a metal or a resin that is relatively thick and stiff.

With this configuration, even if the strength of the contact member 22 is relatively weak, the shape thereof can be secured. Accordingly, the thickness of the contact member 22 can be reduced and therefore the temperature can rise in a short period of time.

In a case in which the contact member 22 is held by and fixed to the retainer or the bracket member 240 as described above, when the contact member 22 is pressed by the pressure roller 31, it is preferable that the shape of the contact member 22 elastically deforms in accordance with the shape of the retainer or the bracket member 240, that is, the shape of the contact member 22 is curved along the retainer or the bracket member 240.

Figure 23:
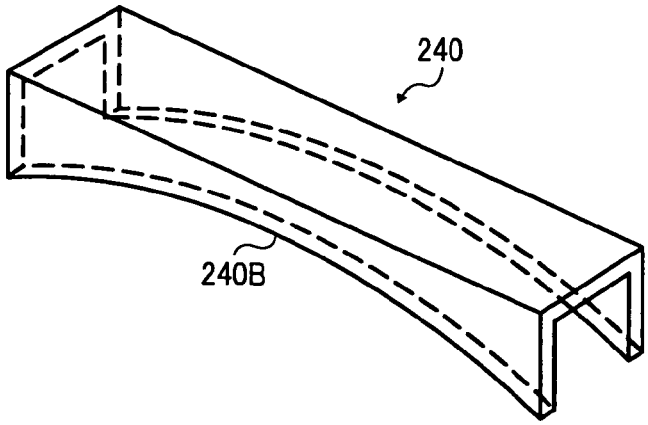
FIG. 23 is a schematic diagram illustrating an example of the retainer of FIG. 22.

In order to achieve such a configuration, as illustrated in FIG. 23, at least a portion of the retainer or the bracket member 240, on which the contact member 22 is mounted, that is, a mounting surface 240B, has a curved shape.

Alternatively, the entire retainer or the bracket member 240 may have a curved shape.

Figure 24:
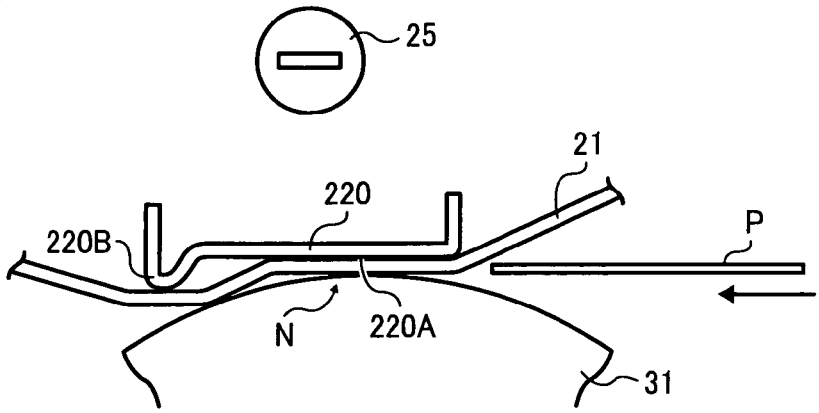
FIG. 24 is a schematic diagram illustrating a variation of the contact member including a protruding portion.

Referring now to FIG. 24, there is provided an enlarged view of another example of a contact member.

According to the illustrative embodiments, as illustrated in FIG. 16, the contact member 22 has the irregular surface relative to the sheet transport direction. Alternatively, as illustrated in FIG. 24, a contact member 220 partially includes a protruding portion 220B.

As illustrated in FIG. 24, the protruding portion 220B is provided at a place further downstream of the nip portion N in the direction of sheet transport indicated by arrow and where the protruding portion 220B does not contact the pressure roller 31 when the pressure roller 31 presses.

With this configuration, the end of the nip portion N, that is, the downstream in the direction of sheet transport, is located substantially at the pressure roller 31 side. Accordingly, after the recording medium P passes the nip portion N, the protruding portion 220B guides the recording medium P toward the pressure roller 31, thereby facilitating the recording medium P to separate from the fixing film 21.

Furthermore, since the protruding portion 220B is located further downstream of the sheet transport direction than the nip portion N, a surface 220A facing the pressure roller 31 constituting the nip portion N can be a flat surface, thereby preventing cockling or the like on the recording medium P. Since the protruding portion 220B is not in contact with the pressure roller 31, undesirable pressure is not applied on the recording medium P, thereby preventing cockling or the like on the recording medium P.

Figure 25:
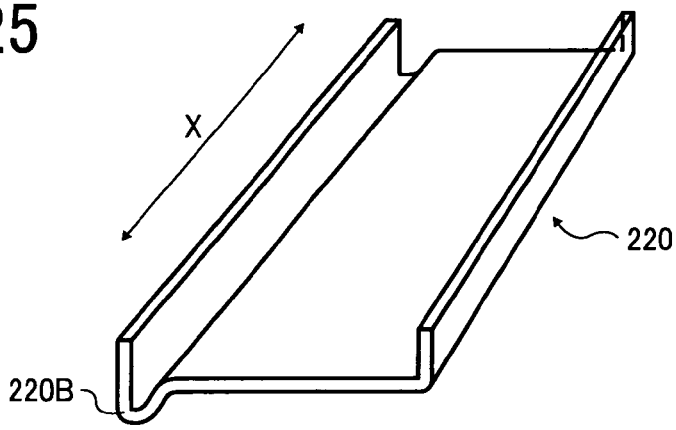
FIG. 25 is a schematic diagram illustrating the contact member of FIG. 24 having the protrusion in the longitudinal direction.

The protruding portion 220B is formed partially on the contact member 220. Alternatively, as illustrated in FIG. 25, the protruding portion 220B has substantially the same shape in cross-section in the longitudinal direction X perpendicular to the sheet transport direction and is formed further downstream of the nip portion N in the direction of sheet transport.

In this case, the length of the contact member 220 in the longitudinal direction X is configured no less than the maximum width of the recording medium P. Accordingly, any size of the recording medium P can be accommodated and easily separated.

Figure 26:
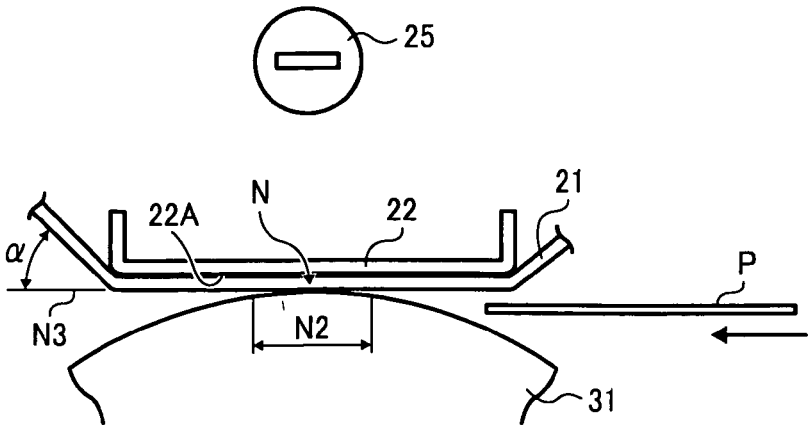
FIG. 26 is a schematic diagram illustrating a fixing member raised substantially above a nip surface.

As illustrated in FIG. 26, the length of the contact member 22 in the direction of sheet transport can be greater than the nip width N2 of the nip portion N.

With this configuration, when the contact member 22 presses against the fixing film 21 so as to form the nip portion N between the contact member 22 and the pressure roller 31, the fixing film 21 is raised by a degree a from a contact surface (nip surface) N3 on which the fixing film 21 and the pressure roller 31 contact.

In addition to the fixing film 21 raised, since resilience of the recording medium P maintains the recording medium P in a flat shape, separation of the recording medium P from the fixing film 21 is improved.

According to the illustrative embodiments described above, the fixing film 21 is provided to the periphery of the cylindrical retainer 24 and pressed by the pressure roller 31.

Figure 27:
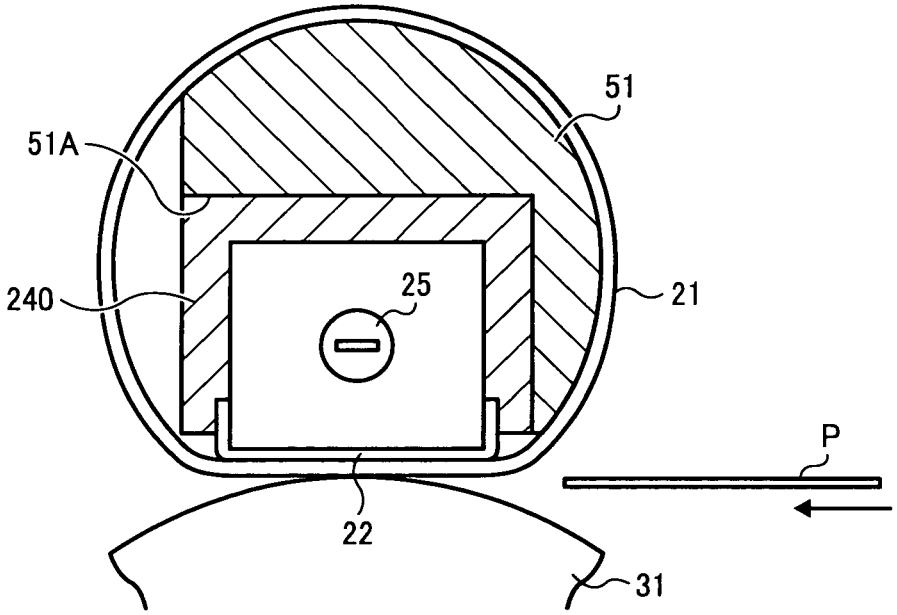
FIG. 27 is a schematic diagram illustrating a guide member that supports the contact member.

Alternatively, as illustrated in FIG. 27, a guide rib 51 is provided to guide the fixing film 21. The peripheral surface of the guide rib 51 is formed substantially in the shape of an arc.

The guide rib 51 includes an incision 51A to which the retainer or the bracket 240 having the inverted U-shape is mounted. The contact member 22 is supported by and fixed to the retainer or the bracket 240.

The fixing film 21 is configured to be raised by the degree $\alpha$ from the contact surface (nip surface) N3 as illustrated in FIG. 26. In other words, when the fixing film 21 is guided by the guide rib 51, the fixing film 21 is raised by the degree $\alpha$ from the contact surface (nip surface) N3.

According to this configuration, the guide rib 51 is disposed so as not to be linear in the direction of rotation of the fixing film 21, thereby preventing heat from escaping through the fixing film 21 to the guide rib 51, and thus preventing fixing failure due to insufficient heat.

Figure 28:
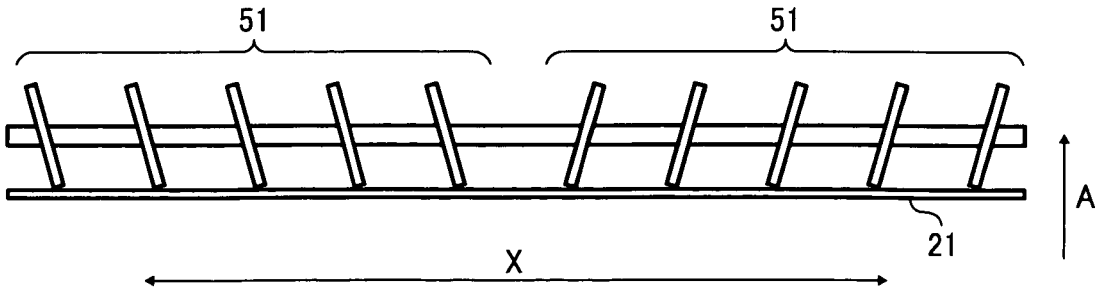
FIG. 28 is a schematic diagram illustrating a plurality of the guide members of FIG. 27 provided in the longitudinal direction of the contact member.

As illustrated in FIG. 28, a plurality of the guide ribs 51 is provided along the longitudinal direction indicated by arrow X of the contact member 22. The guide ribs 51 are arranged symmetrical about substantially the center of the longitudinal direction X and tilted toward the center from both ends in the longitudinal direction X.

Normally, when the guide ribs 51 contact the fixing film 21, the guide ribs 51 take heat away from the fixing film 21. Therefore, if the guide ribs 51 contact only particular locations of the fixing film 21, the temperature of those locations of the fixing film decreases, causing fixing failure, as compared with other locations not contacting the guide ribs 51, In view of the above, as illustrated in FIG. 28, when the plurality of the guide ribs 51 are arranged symmetrical about substantially the center of the longitudinal direction X and tilted toward the center from both ends, that is, when the plurality of the guide ribs 51 is disposed so as not to be linear in the rotational direction of the fixing film 21 indicated by arrow A, the guide ribs 51 are prevented from contacting only the particular locations of the fixing film 21 while the fixing film 21 rotates. Consequently, fixing failure is prevented.

With this simple configuration, the fixing film 21 can reliably separate from the recording medium P in a planar direction of the contact member 22 immediately after contacting the contact member 22.

It is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device, comprising:

a fixing member provided in a width direction of a recording medium, configured to heat and fuse a toner image onto the recording medium;

a pressure member configured to press against the fixing member;

a contact member provided inside the fixing member, configured to contact the pressure member through the fixing member to form a nip portion between the pressure member and the fixing member, the contact member includes a flat surface facing the pressure member; and a heater including a heating element, configured to heat the contact member, wherein the heating element of the heater includes a moldable member having a thin plate extending in a width direction of the fixing member and includes a flat surface that faces the contact member, and wherein a length of the flat surface of the heating element in a width direction of the recording medium is longer than a length of the nip portion in the width direction of the recording medium.

2. The fixing device according to claim 1, wherein a width of the flat surface of the heating element in a direction of sheet transport is greater than a width of the nip portion in the direction of sheet transport.

3. The fixing device according to claim 1, wherein the contact member is formed of flexible material, and the heating element is disposed parallel to the contact member when the contact member the pressure member through via the fixing member.

4. The fixing device according to claim 1, wherein an amount of radiant heat from one end of the heating element is larger than that from the other end.

5. The fixing device according to claim 4, wherein at least one end of the heating element in the longitudinal direction thereof includes a notch.

6. The fixing device according to claim 4, wherein the width of at least one end of the heating element in the longitudinal direction thereof is narrower than the width of a center of the heating element.

7. The fixing device according to claim 4, wherein a thickness of at least one end of the heating element in the longitudinal direction thereof is thinner than the thickness of the center of the heating element.

8. The fixing device according to claim 4, wherein an electrical resistance of a material used for at least one end of the heating element in the longitudinal direction thereof is higher than that of the center thereof by adding an additive to the heating element.

9. The fixing device according to claim 1, further comprising a reflective member provided opposite the contact member through the heater.

10. The fixing device according to claim 1, wherein the heater comprises a sealing tube that encloses the heating element and a surface of the sealing tube opposite the contact member is provided with a reflective member.

11. The fixing device according to claim 10, wherein at least a portion of the sealing tube facing the contact member has a flat surface.

12. The fixing device according to claim 10, wherein at least a portion of the sealing tube facing the reflective member has a flat surface.

13. The fixing device according to claim 10, further comprises a temperature sensor that detects a temperature of the sealing tube, wherein power to the heating element is cut off when the temperature sensor detects a predetermined temperature.

14. The fixing device according to claim 1, wherein the heater is a carbon-based heater.

15. The fixing device according to claim 1, wherein the contact member includes extending members extending toward the heating member at each side of the flat surface of the contact member.

16. The fixing device according to claim 1, wherein the contact member is supported by and fixed to a retainer.

17. The fixing device according to claim 16, wherein the contact member faces an opening formed in the retainer.

18. An image forming apparatus for forming an image, comprising:

an image bearing member configured to bear an electrostatic latent image on a surface thereof;

a developing device configured to develop the electrostatic latent image formed on the image bearing member using toner to form a toner image;

a transfer device configured to transfer the toner image on the image bearing member onto a recording medium;

a fixing device, including:

a fixing member provided in a width direction of the recording medium, configured to heat and fuse the toner image on the recording medium;

a pressure member configured to press against the fixing member;

a contact member provided inside the fixing member, configured to contact the pressure member through the fixing member to form a nip portion between the pressure member and the fixing member, the contact member includes a flat surface facing the pressure member; and a heater including a heating element, configured to heat the contact member, wherein the heating element of the heater is a moldable member including, a thin plate extending in a width direction of the fixing member and includes a flat surface that faces the contact member, and wherein a length of the flat surface of the heating element in a width direction of the recording medium is longer than a length of the nip portion in the width direction of the recording medium.

19. The image forming apparatus according to claim 18, wherein power is not supplied to the heater of the fixing device when no recording medium is present.

20. A fixing device, comprising:

a fixing member provided in a width direction of a recording medium, configured to heat and fuse a toner image onto the recording medium;

a pressure member configured to press against the fixing member;

a contact member provided inside the fixing member, configured to contact the pressure member through the fixing member to form a nip portion between the pressure member and the fixing member, the contact member includes a flat surface facing the pressure member; and a heater including a heating element, configured to heat the contact member, wherein the heating element of the heater includes a moldable member having a thin plate extending in a width direction of the fixing member and includes a flat surface that faces the contact member, wherein an amount of radiant heat from one end of the heating element is larger than that from the other end, and wherein an electrical resistance of a material used for at least one end of the heating element in the longitudinal direction thereof is higher than that of the center thereof by adding an additive to the heating element.

21. A fixing device, comprising:

a fixing member provided in a width direction of a recording medium, configured to heat and fuse a toner image onto the recording medium;

a pressure member configured to press against the fixing member;

a contact member provided inside the fixing member, configured to contact the pressure member through the fixing member to form a nip portion between the pressure member and the fixing member, the contact member includes a flat surface facing the pressure member; and a heater including a heating element, configured to heat the contact member, wherein the heating element of the heater includes a moldable member having a thin plate extending in a width direction of the fixing member and includes a flat surface that faces the contact member, and wherein the heater includes a sealing tube that encloses the heating element, and a surface of the sealing tube opposite the contact member is provided with a reflective member.

22. A fixing device, comprising:

a fixing member provided in a width direction of a recording medium, configured to heat and fuse a toner image onto the recording medium;

a pressure member configured to press against the fixing member;

a contact member provided inside the fixing member, configured to contact the pressure member through the fixing member to form a nip portion between the pressure member and the fixing member, the contact member includes a flat surface facing the pressure member; and a heater including a heating element, configured to heat the contact member, wherein the heating element of the heater includes a moldable member having a thin plate extending in a width direction of the fixing member and includes a flat surface that faces the contact member, and wherein the contact member includes extending members extending toward the heating member at each side of the flat surface of the contact member.

23. An image forming apparatus for forming an image, comprising:

an image bearing member configured to bear an electrostatic latent image on a surface thereof;

a developing device configured to develop the electrostatic latent image formed on the image bearing member using toner to form a toner image;

a transfer device configured to transfer the toner image on the image bearing member onto a recording medium;

a fixing device, including:

a fixing member provided in a width direction of the recording medium, configured to heat and fuse the toner image on the recording medium;

a pressure member configured to press against the fixing member;

a contact member provided inside the fixing member, configured to contact the pressure member through the fixing member to form a nip portion between the pressure member and the fixing member, the contact member includes a flat surface facing the pressure member; and a heater including a heating element, configured to heat the contact member, wherein the heating element of the heater is a moldable member having a thin plate extending in a width direction of the fixing member and includes a flat surface that faces the contact member, wherein an amount of radiant heat from one end of the heating element is larger than that from the other end, and wherein an electrical resistance of a material used for at least one end of the heating element in the longitudinal direction thereof is higher than that of the center thereof by adding an additive to the heating element.

24. An image forming apparatus for forming an image, comprising:

an image bearing member configured to bear an electrostatic latent image on a surface thereof;

a developing device configured to develop the electrostatic latent image formed on the image bearing member using toner to form a toner image;

a transfer device configured to transfer the toner image on the image bearing member onto a recording medium;

a fixing device, including:

a fixing member provided in a width direction of the recording medium, configured to heat and fuse the toner image on the recording medium;

a pressure member configured to press against the fixing member;

a contact member provided inside the fixing member, configured to contact the pressure member through the fixing member to form a nip portion between the pressure member and the fixing member, the contact member includes a flat surface facing the pressure member; and a heater including a heating element, configured to heat the contact member, wherein the heating element of the heater is a moldable member having a thin plate extending in a width direction of the fixing member and includes a flat surface that faces the contact member, and wherein the heater includes a sealing tube that encloses the heating element, and a surface of the sealing tube opposite the contact member is provided with a reflective member.

25. An image forming apparatus for forming an image, comprising:

an image bearing member configured to bear an electrostatic latent image on a surface thereof;

a developing device configured to develop the electrostatic latent image formed on the image bearing member using toner to form a toner image;

a transfer device configured to transfer the toner image on the image bearing member onto a recording medium;

a fixing device, including:

a fixing member provided in a width direction of the recording medium, configured to heat and fuse the toner image on the recording medium;

a pressure member configured to press against the fixing member;

a contact member provided inside the fixing member, configured to contact the pressure member through the fixing member to form a nip portion between the pressure member and the fixing member, the contact member includes a flat surface facing the pressure member; and a heater including a heating element, configured to heat the contact member, wherein the heating element of the heater is a moldable member having a thin plate extending in a width direction of the fixing member and includes a flat surface that faces the contact member, and wherein the contact member includes extending members extending toward the heating member at each side of the flat surface of the contact member.

* * * * *

UNITED STATES PATENT AND TRADEMARK OFFICE

CERTIFICATE OF CORRECTION

PATENT NO. : 8,428,498 B2
APPLICATION NO. : 12/379233
DATED : April 23, 2013
INVENTOR(S) : Fujiwara et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 631 days.

Signed and Sealed this
Twenty-third Day of December, 2014

Michelle K. Lee

Michelle K. Lee
*Deputy Director of the United States Patent and Trademark Office*